United States Patent [19]

Matsui

[11] Patent Number: 4,587,765

[45] Date of Patent: May 13, 1986

[54] METHOD OF AN APPARATUS FOR GRINDING WORK SURFACE

[75] Inventor: Satoshi Matsui, Ebina, Japan

[73] Assignee: Hitachi Seiko, Ltd., Tokyo, Japan

[21] Appl. No.: 581,269

[22] Filed: Feb. 17, 1984

Related U.S. Application Data

[63] Continuation of Ser. No. 358,675, Mar. 16, 1982, abandoned.

[30] Foreign Application Priority Data

Mar. 16, 1981 [JP] Japan ..... 56-36469

[51] Int. Cl.[4] ..... B24B 7/02

[52] U.S. Cl. ..... 51/56R; 51/134; 51/165.73

[58] Field of Search ..... 51/56 R, 165.92, 165.93, 51/165.73, 134, 322

[56] References Cited

U.S. PATENT DOCUMENTS

| | | | |
|---|---|---|---|
| 1,138,683 | 5/1915 | Murray | 51/56 |
| 2,127,071 | 8/1938 | Schmalz | 51/56 |
| 2,195,065 | 3/1940 | Wallace | 51/56 |
| 2,370,813 | 3/1944 | Portman | 51/56 |
| 2,612,008 | 9/1952 | Kuniholm | 51/165.93 |
| 2,629,972 | 3/1953 | Garrison | 51/56 |
| 2,664,787 | 1/1954 | Plimmer | 51/165.73 |
| 3,399,498 | 9/1968 | Lampani | 51/134 |
| 3,952,456 | 4/1976 | Leathley | 51/56 R |
| 4,318,250 | 3/1982 | Klievoneit | 51/56 R |
| 4,481,738 | 11/1984 | Tabuchi | 51/134 |

FOREIGN PATENT DOCUMENTS

| | | | |
|---|---|---|---|
| 48462 | 3/1982 | Japan | 51/56 R |

*Primary Examiner*—Harold D. Whitehead

*Attorney, Agent, or Firm*—Antonelli, Terry & Wands

[57] ABSTRACT

A method of and apparatus for grinding a work by a surface grinder having a rotating grinding wheel with a flat grinding surface. During the grinding of the work, a support for the spindle of the rotating grinding wheel is moved in the direction of a thermal distortion of the support which is caused by the heat generated in a spindle head rotatably mounting the grinder spindle, thereby to obviate any reduction in the precision of grinding attributable to an inclination of the grinding surface caused by the thermal distortion of the support.

10 Claims, 13 Drawing Figures

METHOD OF AN APPARATUS FOR GRINDING WORK SURFACE

This is a continuation of application Ser. No. 358,675 filed Mar. 16, 1982 and now abandoned.

BACKGROUND OF THE INVENTION

The present invention relates to a method of and apparatus for grinding a workpiece consisting of a thin plate-like member such as a silicon wafer.

Basic arrangement of conventional surface grinder for grinding a workpiece of thin plate-like member can be sorted into four types as shown in FIGS. 1*a* to 1*d* according to the direction of the axis of the spindle which supports and drives the grinding wheel and the shape of the table mounting the work. Namely, FIG. 1*a* shows a surface grinder of vertical shaft and rotatable circular table type having a spindle 1*a* whose axis extends vertically. A grinding wheel 2*a* attached to the lower end of the spindle 1*a* rotates in the direction of the arrows with its side surface consisting the grinding surface. A circular table 4*a* carrying a workpiece 3*a* having the surface to be treated directed upwardly and held horizontally is adapted to rotate in the direction of the arrow. FIG. 1*b* shows a surface grinder of vertical shaft and reciprocatable angular table type in which a grinding wheel 2*b* is fixed to the lower end of a spindle 1*b* having a vertical axis such that its side surface constitutes the grinding surface and is rotated in the direction of the arrow. An angular table 4*b* carries a workpiece 3*b* such that the surface to be treated is held horizontally and directed upwardly and is adapted to move reciprocatingly in the horizontal direction. FIG. 1*c* shows a surface grinder of horizontal shaft and rotatable circular table type consisting of a spindle 1*c* having a horizontal axis, a grinding wheel 2*c* fixed to one end of the shaft 1*c* and rotatable in the direction of the arrow with its peripheral surface constituting the grinding surface, and a circular table 4*c* which rotates in the direction of the arrow while carrying a workpiece 3*c* such that the surface to be ground is held horizontally and directed upwardly. FIG. 1*d* shows a surface grinder of horizontal shaft and reciprocatable angular table type having a spindle 1*d* having a horizontal axis, a grinding wheel 2*d* fixed to one end of the spindle and rotatable in the direction of the arrow with its peripheral surface constituting a grinding surface, and an angular table 4*d* adapted to move reciprocatingly in the horizontal direction while carrying a workpiece 3*d* such that the surface to be ground is directed upwardly and held horizontally.

In any one of the above-mentioned four types of surface grinders, the feed of the grinding wheel 2*a*, 2*b*, 2*c* and 2*d* has been achieved relatively to the workpiece 3*a*, 3*b*, 3*c* and 3*d* by horizontal movement of the table 4*a*, 4*b*, 4*c* and 4*d*. Namely, only the table is moved while the grinding wheel rotates at a stationary position during the grinding.

Therefore, the following problems are encountered in the grinding of a workpiece by the above-explained conventional surface grinders.

In the conventional surface grinders, as schematically shown in FIG. 2, a spindle head 7 is adapted to slide along the vertical guide surface 6' formed on a column 6 fixed to a bed 5. A spindle 8 is rotatably mounted in the head 7 with the axis thereof extended vertically. A grinding wheel 9 is fixed to the lower end of the spindle 8 and is adapted to rotate in the direction of the arrow while keeping its grinding surface horizontal. A table 10 is mounted horizontally and rotatably on the bed 5 and carries at its upper surface a workpiece 11. In this type of surface grinder, the grinder as a whole is symmetrically constructed across the spindle 8. Therefore, although the heat generated in the spindle head 7, as a result of rotation of the spindle 8, is transmitted to the column 6 through the guide surface 6', the the column 6 is heated so that the column 6 is not thermally distorted in the fore and aft direction. However, as to the right and left direction, the column 6 is heated only at the side thereof contacted by the spindle head 7, so that the column 6 is thermally distorted and bent as illustrated in an exaggerated manner. This in turn declines the grinding surface of the grinding wheel 9 through the spindle head 7 and the spindle 8. In this case, when the feed is made by moving the table 10 in the horizontal direction, the work 11 is ground following the declined grinding surface, so that the precision of grinding is deteriorated considerably. Therefore, it has been proposed to correct the levelness of the declined grinding surface of the grinding wheel by dressing. As schematically shown in FIG. 3, the most ordinary method for effecting the dressing is to rotate the central portion of the grinding surface of the grinder wheel 9 in contact with a dresser 12 fixed to the table 10 which is kept still during dressing. With this method, however, it is not possible to recover the perfect levelness of the grinding surface of the grinding wheel because the upper end portion of the dresser 12 effects the dressing following the declined grinding surface of the grinding wheel 9.

FIG. 4 shows an example of a grinding apparatus of the type described heretofore, applied to the grinding of silicon wafer. In this case, a rough grinding wheel 13*a* and a finish grinding wheel 13*b* are arranged in a side-by-side relation, while two workpieces 15 are mounted on a table 14 so that these workpieces 15 are simultaneously ground by respective grinding wheels.

According to this arrangement, the rough grinding performed by the rough grinding wheel 13*a* and the finish grinding performed by the finish grinding wheel 13*b* are made along paths a and b of the same pattern. This inconveniently promotes the tendency of hair crack in the workpieces.

FIG. 5 shows another example of application of the surface grinder in which a plurality of workpieces 15*a*, 15*b* and 15*c* are mounted on a table 14, so that, while workpieces 15*a* is being ground, another workpiece 15*b*, previously ground is taken out of the table 14 or still another workpiece 15*c* to be ground, is attached to the table 14. In this arrangement, it is necessary to lower the speed of movement of the table 14 to a level which is suitable for attaching and detaching of the workpieces 15*b*, 15*c*, resulting in a reduction of the grinding efficiency. According to this grinding method, therefore, the table 14 is temporarily stopped when the grinding is finished with the workpiece 15*a* to permit attaching and detaching of the workpieces 15*c* and 15*b* to and from the table 14. Consequently, the efficiency of the whole grinding operation is lowered disadvantageously.

SUMMARY OF THE INVENTION

Accordingly, a major object of the invention is provide a surface grinding method and apparatus capable of overcoming the above-described problems of the prior art.

To this end, according to one aspect of the invention, there is provided a surface grinding method in which a rotating grinding wheel having a flat grinding surface is moved linearly in the direction of the thermal distortion of a support by which the grinding wheel is supported, to thereby grind the work surface. According to this method, it is possible to grind the work to obtain a flat ground surface at a high precision, even though there is a slight decline of the grinding surface of the grinding wheel due to the thermal distortion of the support.

According to another aspect of the invention, the grinding mentioned above is achieved while maintaining the rotatable table carrying the workpieces stationary. It is, therefore, possible to attach and detach the workpiece to and from to the table at any desired position on the periphery of the table when the table is stopped.

DETAILED DESCRIPTION OF THE PREFERRED EMBODIMENTS

Figure 1A:
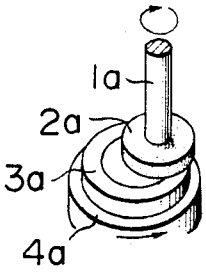
FIG. 1(a) PRIOR ART
FIG. 1*a* is a schematic illustration of a conventional surface grinder of vertical shaft and circular rotatable table type.
Figure 1B:
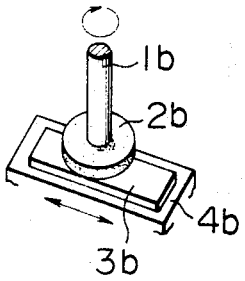
FIG. 1(b) PRIOR ART
FIG. 1*b* is a schematic illustration of a conventional surface grinder of vertical shaft and angular reciprocatable table type.
Figure 1C:
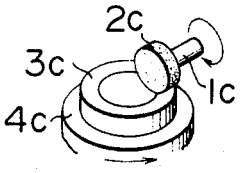
FIG. 1(c) PRIOR ART
FIG. 1*c* is a schematic illustration of a conventional surface grinder of horizontal shaft and circular rotatable table type.
Figure 1D:
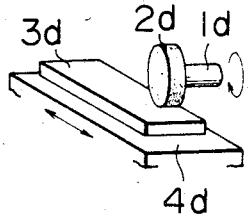
FIG. 1(d) PRIOR ART
FIG. 1*d* is a schematic illustration of a conventional surface grinder of horizontal shaft and angular reciprocatable table type.
Figure 2:
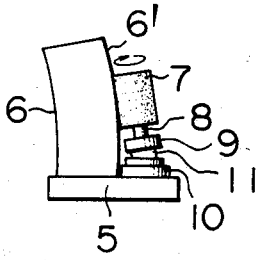
FIG. 2 PRIOR ART
FIG. 2 is a side elevational view of an essential part of a conventional surface grinder.
Figure 3:
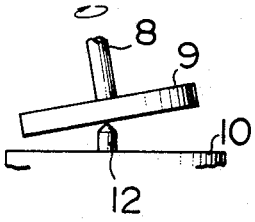
FIG. 3 PRIOR ART
FIG. 3 is a schematic illustration of a conventional dressing technique for surface grinder.
Figure 4:
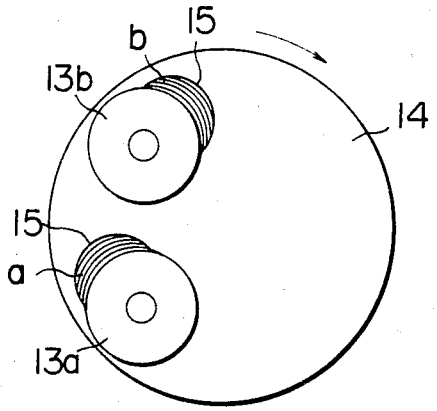
FIG. 4 PRIOR ART
FIG. 4 is a plan view schematically showing the relationship between the grinding wheels and workpieces on a single grinder adapted to effect both of rough grinding and finish grinding simultaneously.
Figure 5:
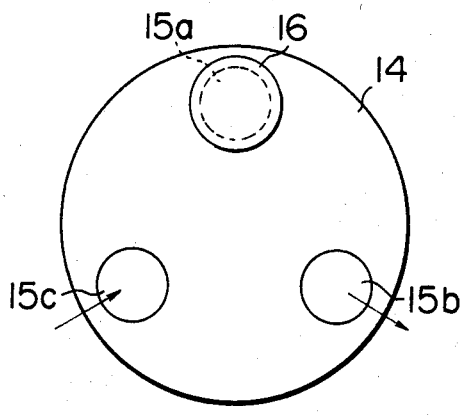
FIG. 5 PRIOR ART
FIG. 5 is a plan view schematically showing the relationship between the grinding wheel and workpieces on a surface grinding apparatus in which the grinding of a work and attaching and detaching of other workpieces are made simultaneously.
Figure 6:
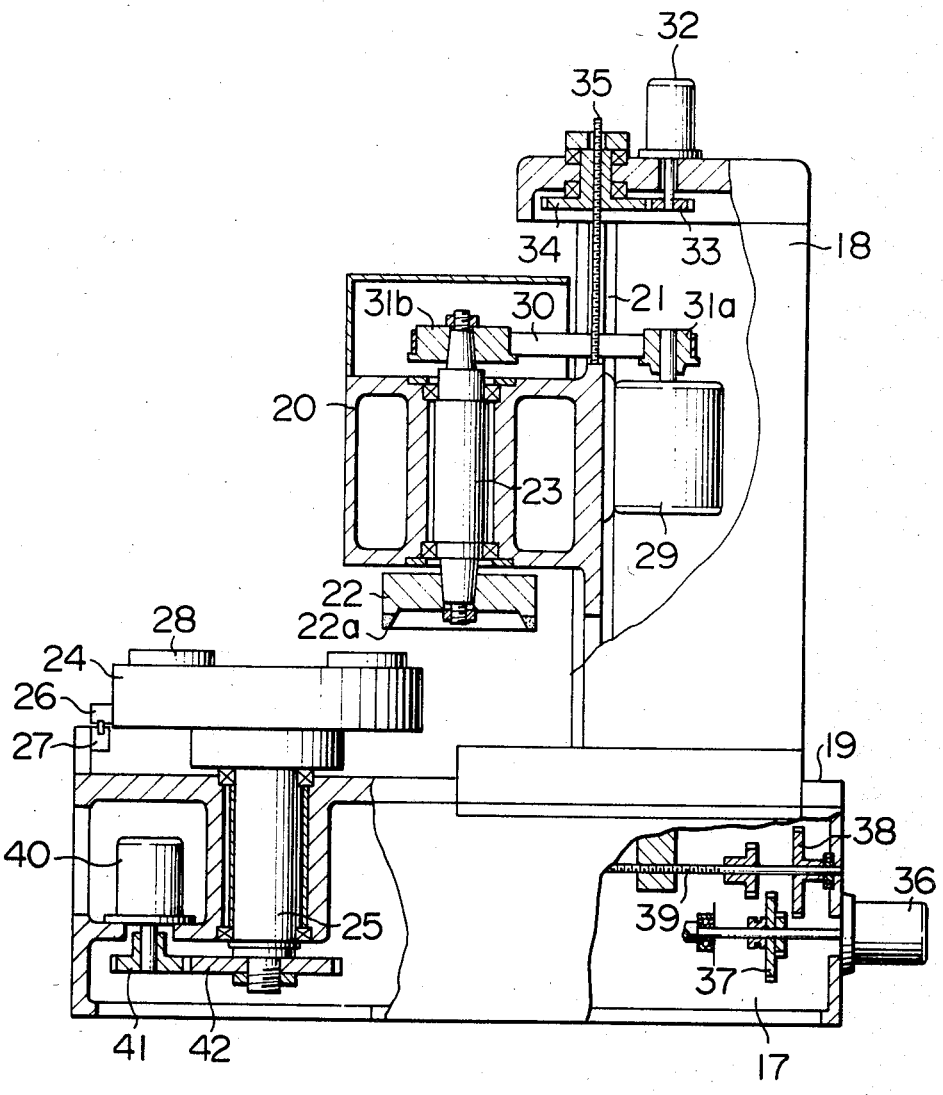
FIG. 6 is a sectional side elevational view of a grinding apparatus in accordance with an embodiment of the invention.

As shown in FIG. 6 the surface grinding apparatus has a bed 17 and a column 18 which is carried by the bed 17 and slidable to the left and right as viewed in the Figure along a horizontal guide surface 19 provided on the bed 17. A spindle head 20 is vertically slidable along a vertical guide surface 21 provided on the column 18. A grinding wheel 22 is fixed to the lower end of a grinder shaft 23 which is rotatably held by the spindle head 20 with its axis oriented in the vertical direction. The lower surface of the grinding wheel 22 constitutes a grinding surface which is held horizontally.

A table 24 is fixed horizontally to a vertical spindle 25 which is held rotatably by the bed 17 so as to extend in parallel to the grinding shaft 23. A dog 26 is fixed to a portion of the peripheral surface of the table 24. A plurality of limit switches 27, corresponding in number to the workpieces on the table 24, are disposed around the table 24 at a constant circumferential pitch so as to be able to be contacted by the dog 26. A drive unit for the grinder shaft includes a drive motor 29 for driving the grinder shaft 23, belt 30, pulleys 31*a*, 31*b* and other associated parts. On the other hand, a drive unit for the spindle head 20 is constituted by a spindle head drive motor 32, gears 33, 34 a feed screw 35 and other parts. Also, a drive unit for the column 18 includes a column drive motor 36, 2-staged speed changing gear 37, 38, feed screw 39 and other associated parts. A spindle drive motor 40 is adapted to rotatingly drive the spindle 25 and the table 24 through gears 41 and 42. The indexing of the table 24 is made by the cooperation between the dog 26 and the limit switches 27 through detection of the angle of rotation of the table 24.

In the surface grinding apparatus described above, the grinding wheel 22 is rotatively driven by the grinder shaft 23 which, in turn, is driven by the motor 29 through the belt 30 stretched between two pulleys 31*a* and 31*b*. Also, the cutting by the grinding wheel 22 into the work 28 is achieved by the spindle head 20 which is moved vertically along the guide surface 21 of the column 18 by the power of the motor 32 transmitted through two gears 33, 34 and the feed screw 35. The feed of the grinding wheel 20 with respect to the work 28 is effected by the column 18 which is horizontally slidable along the horizontal guide surface 19 of the bed 17 by the power from the motor 36 through the two-staged reduction gear 37, 38 and the feed screw 39. The rotation of the table 24 is stopped during the grinding. After the grinding is finished, the motor 40 rotates the table 24 in the horizontal plane through the gears 41 and 42. As the table 24 is rotated by a predetermined angle to bring the dog 26 into contact with one of the limit switches 27, the motor 40 is stopped thus completing an indexing of a predetermined angle.

A practical example of the grinding operation by the apparatus shown in FIG. 6, when the workpiece 28 is a silicon wafer, will be explained hereinunder.

Figure 7A:
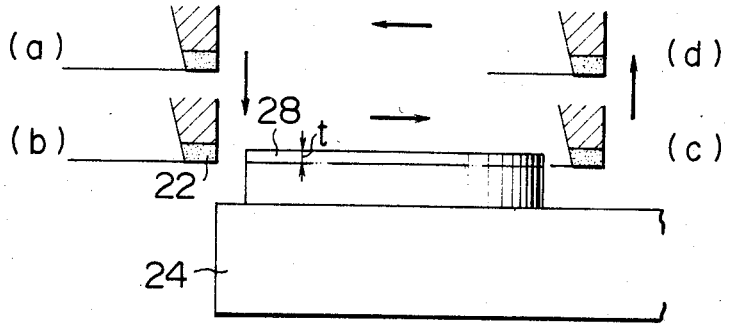
FIGS. 7(*a*) and 7(*b*) are schematic side elevational view and a schematic plan view showing the relationship between the grinding wheels of different coarsnesses and workpieces when rough grinding of a succeeding workpiece and finish grinding of a preceding workpiece are simultaneously performed by the apparatus shown in FIG. 6.
Figure 7B:
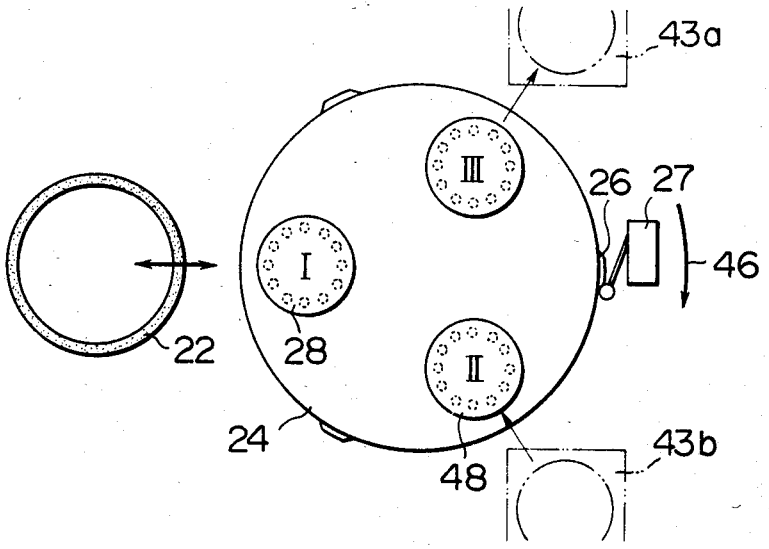

Referring to FIG. 7(*a*) the grinder wheel 22 is positioned in the initial state at a starting position (a) which is spaced by predetermined distances in both vertical and horizontal directions. The grinding wheel 22 is then lowered from the starting position (a) to a position (b) corresponding to the finish size of the workpiece 28. Then, the grinding wheel 22 is fed horizontally and to the right while effecting the grinding and the grinding is completed when the grinding wheel 22 has reached the position (c). Then the grinding wheel 22 is returned quickly to the starting position (a) via a position (d) just above the position (c).

Since the grinding is effected while feeding the grinder in the horizontal direction, the workpiece 28 can be highly precisely ground even if the lower surface of the grinding wheel 22 is declined due to a thermal distortion of the column 18. Namely, according to this embodiment, it is possible to eliminate the influence of the inclination of the grinding wheel attributable to a thermal distortion of the column.

As shown in FIG. 7(*b*), three stations I, II and III are disposed on the table 24 at a constant angular distance which is, in this case, 120°. The stations I, II and III are provided with vacuum chucks 48 or the like means for prompt attaching and detaching of the workpiece 28. As a result of the movement of the grinding wheel 22 from the position (a) to the position (c) past the position (b), the workpiece 28 on the station I is ground by an amount (t). Meanwhile, in the stations II and III, the removal of the workpiece 28, ground in the preceding grinding cycle and mounting of a new workpiece 28 to be ground next, are performed. For effecting the attaching and detaching of the workpiece 28 manually, the workpiece 28 after the grinding is shifted to a cassette 43*a* from the station III and the workpiece 28 to be ground next is supplied to the station II from the cassette 43.

Immediately after the grinding wheel 22 is moved to the position (d) in FIG. 7*a* upon completion of the grinding, the table 24 is rotated, in the direction of the arrow 46, for indexing by an angle of 120° which is effected by the cooperation between the limit switches 27 and the dog 26. When the grinding wheel 22 reaches the starting position (a), the station II carrying the workpiece 28 to be ground next is positioned for grinding in place of the first station I. This operation cycle is conducted repeatedly to effect the grinding of successive workpieces.

The drive units for the column 18, spindle head 20 and the grinder shaft 23, as well as the drive unit for the indexing of the table 24, are operated in accordance with a predetermined sequence by a numerical control or the like control means, to thereby make the repetitious indexing of the table 24 in the returning stroke of the grinding wheel 22. The detail of the control system is not explained nor illustrated because it does not constitute any essential portion of the invention.

Figure 8:
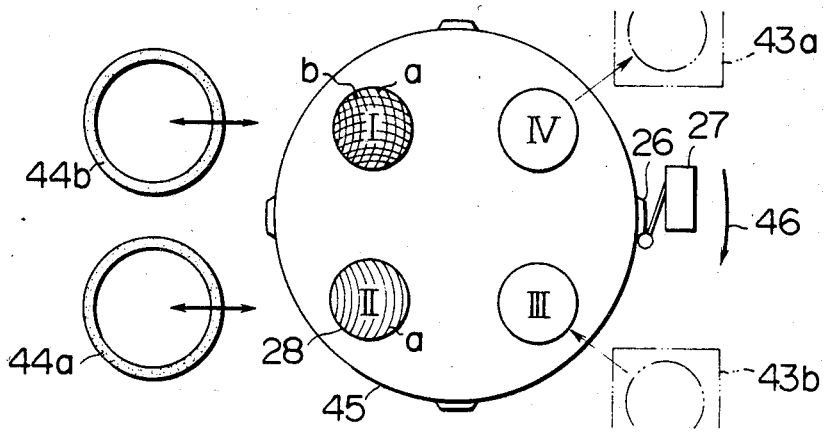
FIG. 8 is a plan view schematically showing the relationship between the grinding wheels and workpiece in a surface grinding apparatus constructed in accordance with the invention and adapted to simultaneously effect both rough grinding and finish grinding of the workpieces.
Figure 9:
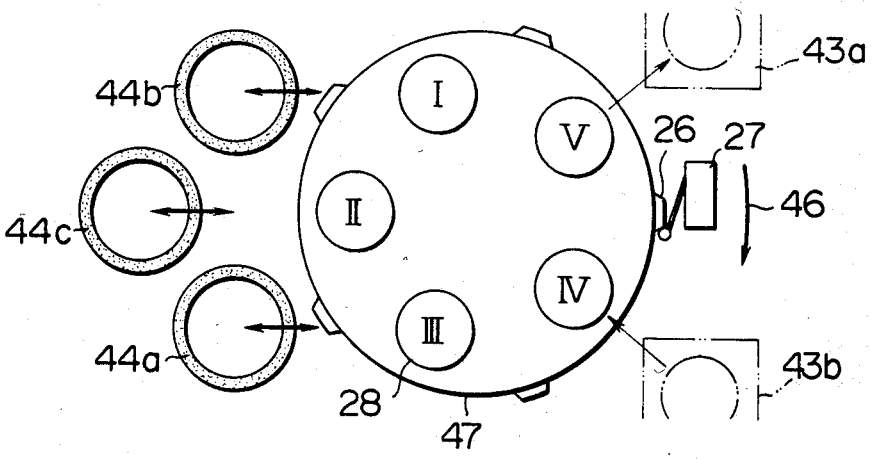
FIG. 9 is a plan view schematically showing the relationship between grinding wheels and workpieces in a surface grinding apparatus in accordance with the invention adapted simultaneously effect rough grinding, half-finish grinding and finish grinding of the workpieces.

In FIG. 8, a rough grinding wheel 44*a* having coarse surface, and a finish grinding wheel 44*b* having a fine grinding surface are adapted to be rotatably driven at speeds suitable for the rough grinding and finish grinding. In addition, the grinding wheels 44*a* and 44*b* simultaneously make the cyclic operation starting from the position (a) and ending in the same position (a) past the positions (b), (c) and (d). As the grinding wheels 44*a* and 44*b* make the movement from the position (a) to the position (c) pass the position (b), a roughly ground workpiece 28 is finish ground in the station I by the finish grinding wheel 44*b* and, at the same time, a new workpiece 28 is roughly ground in the station II by the rough grinding wheel 44*a*. Meanwhile, in the station IV, the finished workpiece 28 is demounted and, in the station III, the workpiece 28 to be ground is mounted. As the grinding is finished with the workpiece 28 in the station I, the workpiece 28 is shifted to the station IV and the roughly ground workpiece 28 is shifted from the station II to the finish grinding position. This operation is repeated to grind successive workpiece. As will be clearly seen from Figure, the locus (c) for effecting the rough grinding by the rough grinding wheel 44*a* in the station II and the locus (d) for effecting the finish grinding by the finish grinding wheel 44*b* in the section III are perpendicular to each other. In the conventional apparatus of the kind described, as explained before, there was a tendency of promotion of hair cracking due to the fact that the finish grinding is made in the same direction as the rough direction. This problem, however, is completely eliminated and, in addition, the smoothness of the finished surface is improved because the finish grinding is made in the direction perpendicular to that of the rough grinding as described above. As shown in FIG. 9, the grinding apparatus includes a half-finish grinding wheel 44*c*, with stations I, II, III, IV, V being arranged on a table 47 at a predetermined angular interval, 72°. The workpiece 28 positioned at the station I is finish ground by the finish grinding wheel 44*b*, while another workpiece 28 positioned at the station II is half-finished by the half-finish grinding wheel 44*c*. At the same time, still another workpiece 28 positioned at the station III is rough ground by the rough grinding wheel 44*a*. The workpiece 28 after the grinding, positioned at the station V, is removed while, in the station IV, a new workpiece 28 to be ground is mounted. The mounting and removal of the workpieces in the stations IV and V are achieved while the workpieces in the stations I, II and III are ground by the respective grinding wheels.

Thus, by increasing the number of grinder shafts and the number of the stations, it is possible to effect the grinding in a multiplicity of stages using a plurality of grinder wheels of different degrees of coarseness. The increase in number of the stations permits also a measurement of workpieces while the other workpieces are being ground. Although in the described embodiment the mounting and removal of the workpieces are made in different stations, the mounting and removal may be made in a single station provided that the mounting and removal are achieved manually.

As has been described, according to the invention, the support for the rotating grinding wheel having a flat grinding surface is moved linearly in the direction of thermal distortion of the support during the grinding. Therefore, it is possible to obtain a highly precisely flattened finished surface of the workpiece, even if there is any decline of the grinding surface of the grinding wheel due to a thermal distortion of the support.

In addition, when a plurality of grinding wheels of different degrees of coarseness are used for achieving the grinding in a plurality of stages, the directions of movement of the grinding wheels are perpendicular to each other so that the tendency of promotion of air crack is suppressed and the precision of grinding is enhanced advantageously.

In addition, since the grinding of one or more workpieces and the mounting and removal of other workpieces are made simultaneously, the time for staging is completely eliminated so that the rear grinding time is the total grinding time. Since the lowering of speed of the table for mounting and removal of the workpieces is not necessary, it is possible to improve the efficiency of the grinding operation. This feature is advantageous particularly when the grinding is effected on a large number of workpieces such as silicon wafers.

What is claimed is:

1. A method of grinding a surface of at least four workpieces in a grinding machine including at least two spindle means each rotatably carrying a rotating grinding wheel having a flat grinding surface, a column means for supporting said spindle means, said column means having a thermal distortion direction, and a bed means for supporting said column means, said four workpieces being mounted on a rotatable table, the method comprising the steps of horizontally moving said rotating grinding wheel in a direction of the thermal distortion of said column support means while stopping the rotation of said table, and simultaneously grinding said work surface of at least two of said workpieces by said grinding surfaces of said grinding wheels during horizontal movement of the rotary grinding wheels by a cyclic grinding operation beginning and ending at the same position of the surface of the respective workpieces.

2. A method of grinding a surface of a workpiece according to claim 1, further comprising the step of mounting and removing other workpieces during the grinding operation.

3. A grinding apparatus comprising a table for mounting at least four workpieces, at least two spindle head means each rotatably carrying a spindle having a grinding wheel mounted thereon, a first driving means for rotatably driving said grinder spindles, a column means for supporting said spindle head means for vertical sliding movement therealong, said column means having a thermal distortion direction, a second driving means for causing the vertical sliding movement of said spindle head means along said column means to thereby effect a cutting by said grinding wheel into two of said workpieces, bed means for carrying said column means for horizontal sliding movement in the direction of thermal distortion of said column means, said column means supporting said at least two spindle means on said bed means so as to enable a simultaneous horizontal sliding movement of said grinding wheels in said thermal distortion direction of said column means so as to enable a simultaneous grinding of two workpieces on said table by the respective grinding wheels, and third driving means adapted to move said column means horizontally in a direction of said thermal distortion of said column means to thereby grind the workpieces on said table by said grinding wheels.

4. A grinding apparatus as claimed in claim 3, wherein said grinding wheel has a flat grinding surface which has a diameter larger than a diameter of the surface of the workpiece.

5. A grinding apparatus as claimed in claim 4, wherein means are provided for rotating said table, and wherein the workpieces are disposed about a peripheral portion of said table.

6. A grinding apparatus as claimed in claim 5, wherein a plurality of means for mounting and removing workpieces are disposed at a plurality of positions along the peripheral portion of said rotatable table.

7. A grinding apparatus as claimed in claim 3, wherein one of said grinding wheels has a coarse surface so as to enable a rough grinding of the workpiece and the other of said grinding wheels has a fine grinding surface so as to enable a finish grinding of the workpiece, and wherein said first driving means includes means for enabling a driving of the respective spindle head means at speeds suitable for a simultaneous rough and finish grinding of the respective two workpieces.

8. A grinding apparatus as claimed in claim 7, wherein each of said grinding wheels has a flat grinding surface of a larger diameter than a diameter of the surface of the workpiece.

9. A grinding apparatus as claimed in claim 8, wherein means are provided for rotating said table, and wherein the workpieces are disposed about a peripheral portion of said table.

10. A grinding apparatus as claimed in claim 3, wherein a plurality of means for mounting and removing workpieces are disposed at a plurality of positions along the peripheral portion of said rotatable table.

* * * * *